United States Patent [19]

Brumfield et al.

[11] 3,977,327

[45] Aug. 31, 1976

[54] CONTROLLED FRAGMENTATION WARHEAD

[75] Inventors: Benjamin R. Brumfield, Seattle; Clayton J. Julien, Kent, both of Wash.

[73] Assignee: United States of America as represented by the Secretary of the Army, Washington, D.C.

[22] Filed: Feb. 4, 1975

[21] Appl. No.: 547,849

Related U.S. Application Data

[63] Continuation of Ser. No. 373,550, June 25, 1973, abandoned.

[52] U.S. Cl. ..... 102/67; 102/DIG. 2

[51] Int. Cl.[2] ..... F42B 13/48

[58] Field of Search ..... 102/64, 67, DIG. 2

[56] References Cited

UNITED STATES PATENTS

| | | | |
|---|---|---|---|
| 723,256 | 3/1903 | Emery | 102/67 |
| 3,263,612 | 8/1966 | Throner, Jr. | 102/67 |
| 3,298,308 | 1/1967 | Throner, Jr. | 102/67 |
| 3,447,463 | 6/1969 | Lavine | 102/67 |
| 3,498,224 | 3/1970 | Cordle et al. | 102/67 |
| 3,667,183 | 7/1972 | Talley | 102/67 |
| 3,853,059 | 12/1974 | Moe | 102/DIG. 2 |

FOREIGN PATENTS OR APPLICATIONS

| | | | |
|---|---|---|---|
| 1,202,477 | 7/1959 | France | 102/67 |
| 1,257,604 | 2/1961 | France | 102/67 |

*Primary Examiner*—Verlin R. Pendegrass
*Attorney, Agent, or Firm*—Nathan Edelberg; A. Victor Erkkila; Thomas R. Webb

[57] ABSTRACT

A controlled fragmentation warhead employing an annular body comprising rows of keystone fragments. The rows of fragments are offset one from another in a specific pattern based on the number of rows of fragments. The explosive charge is positioned inside the annular body formed by the fragments and adjacent to their ends within an enclosed body. The explosive charge is detonated at both ends of the annular body at a precalculated interval to cause the resultant shock wave to disperse the fragments in a controlled and predetermined manner so as to derive optimum destructive force from the kinetic energy of the fragments in relation to the chosen target.

10 Claims, 7 Drawing Figures

Fig. 1
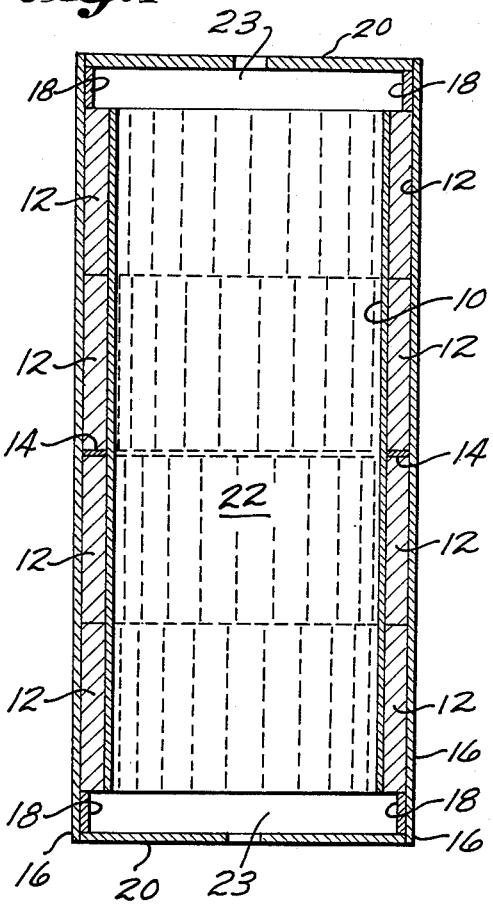
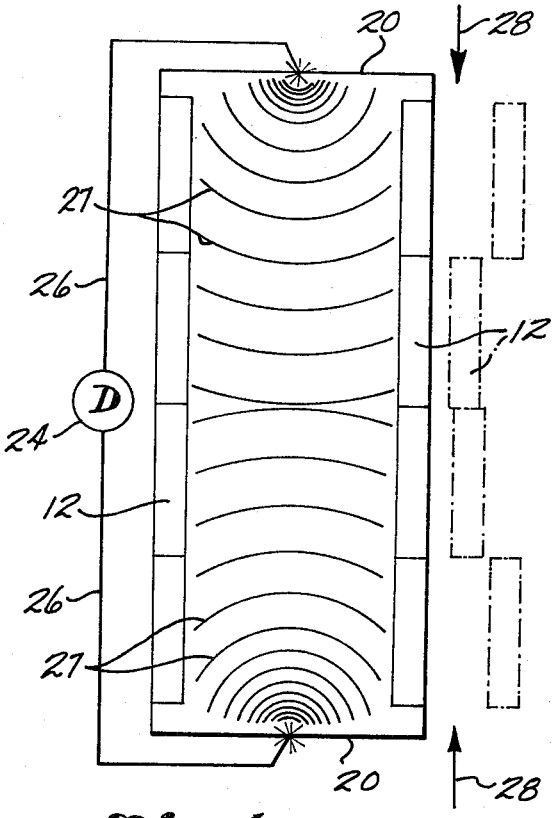
Fig. 4
Fig. 2
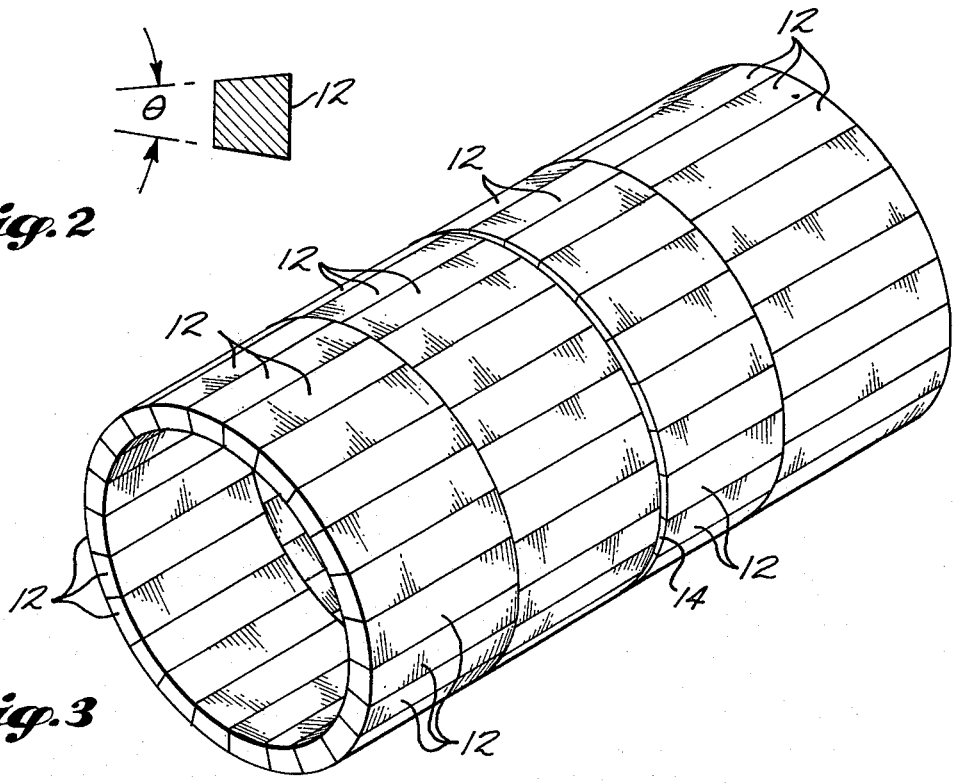
Fig. 3

CONTROLLED FRAGMENTATION WARHEAD

This is a continuation of application Ser. No. 373,550, filed June 25, 1973, and now abandoned.

BACKGROUND OF THE INVENTION a. Field of the Invention

The present invention relates to warheads and more particularly to armor penetrating controlled fragmentation warheads.

b. Description of the Prior Art

Conventional bombs and warheads detonate in a manner that produces fragments of inadequate energy at impact to perforate armor plate of the thickness employed in armored vehicles and tanks. These devices typically distribute their energy into broad patterns with fragments of irregular size and shape. Too few fragments with inadequate kinetic energy are delivered to the target to be effective in defeating the target. Other means of defeating armor that have sufficient energy require great delivery accuracy or a large number of devices to be effective. Two such devices are artillery projectiles and shaped charges. In addition, other prior art methods of explosive detonation have been tried in combination with different size and shape fragments. Only limited success has been achieved because of fragment divergence into too broad a pattern with again too few fragments placed on the target to be effective.

Prior art warheads are based on the presumption that all warheads will explode with a random fragment dispersal. Extensive research in development of the present invention disclosed that fragments of larger mass and of nearly identical shape will disperse in a predictable pattern based on their orientation in the warhead and the configuration and method of detonation of the explosive charge in the warhead.

Based on these findings, the present invention includes several novel features over the teaching of the prior art that make possible the solution of the problem. These are:

1. Explosive tamping — The presence of the main charge high explosive around the ends of the fragment layer maintains ejection of the fragments in a narrow beam when detonated using existing simultaneous or near simultaneous initiation technology. The explosive tamping provides a way to control the fragment beam from the warhead.

2. Fragmentation arrangement — Orientation of the rows of fragments such that no two rows are lined up with each other provides even diametral spacing of the fragments over the area of interest when the warhead is detonated. This improves the likelihood of hitting and defeating a target in the area of interest for the warhead. Since there is a direct relationship between the fragment arrangement in the warhead to the fragment pattern at the target, the warhead can be constructed to produce the optimum pattern for a particular target.

3. Mild steel fragment material — Existing armor penetration theory maintains that in order to penetrate a material, the material of the penetrator must be as hard or harder than the target material. The present invention has used unhardened mild steel fragments that in conjunction with the other features have allowed the armor penetrating fragmentation warhead disclosed herein to perforate more than 4 inches of rolled homogeneous armor in actual demonstration tests.

4. Keystoned preformed fragments — By preforming the fragments, the correct shape and mass to perforate over 4 inches of armor can be constructed to be delivered to the target. Keystoning requires that the two sides of each fragment be inclined toward the center of the warhead so that when assembled in cylindrical fashion, the sides of the fragments will be in total contact with each other. Keystoning of the fragments insures the integrity of the preformed fragments during acceleration by the shock wave from the high explosive detonation of the warhead. Without keystoning the fragments may or may not be ejected from the warhead with the desired mass. Fragment breakup occurs and the predetermined fragment size and shape is not delivered to the target.

Therefore, an object of the present invention is to provide a controlled fragmentation warhead which provides for maximum delivery of kinetic energy to the target.

It is a further object of the present invention to provide a fragmentation warhead with a controlled fragmentation beam.

It is a still further object of the present invention to provide a fragmentation warhead with a controlled fragment delivery pattern.

It is another object of the present invention to provide an armor penetrating controlled fragmentation warhead capable of employing mild steel fragments.

It is yet another object of the present invention to provide an armor penetrating controlled fragmentation warhead with the objectives hereinbefore described which will penetrate 4 inches of armor plate yet which is easily produced with a minimum of specialized equipment and which can be packaged in and delivered by conventional devices.

Other objects and many of the attendant advantages of the present invention will be readily appreciated as the same becomes better understood by reference to the following detailed description when considered in connection with the accompanying drawings.

DESCRIPTION OF THE DRAWINGS

FIG. 1 is a longitudinal cross section through the entire warhead.

FIG. 2 is a cross section of one of the fragments of FIG. 1.

FIG. 3 is the fragmentation portion of the warhead alone.

FIG. 4 is a depiction of the force wave motion and resultant fragment movement from the warhead.

DESCRIPTION AND OPERATION OF THE INVENTION

Figure 5A:
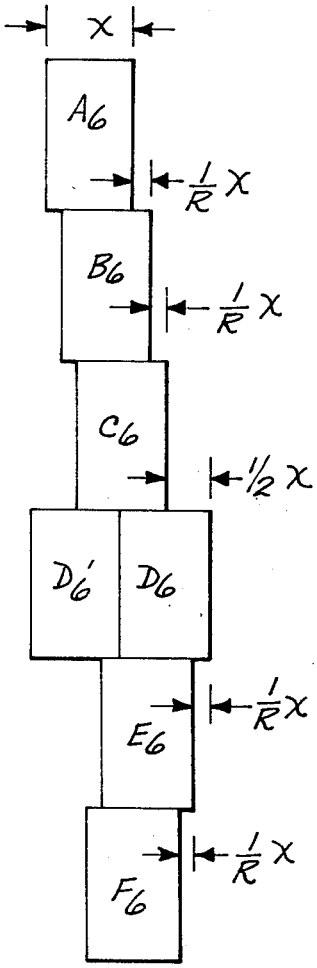
FIG. 5*a*, FIG. 5*b*, and FIG. 5*c* depict the staggering algorithm for the fragment rows as viewed from the outside looking at any typical column of fragments in the warhead.

Prior to construction of the warhead, the size and shape of the fragments must be determined, based on the desired warhead size and the object target - using standard techniques for determination of required kinetic energy for defeating the target and kinetic energy to be available in the fragment from the mass of fragment and explosive charge to be used. In the preferred embodiment it was found that four rows of fragments worked best for the application under test. However, for larger warheads, additional rows may be desired. Considerations relative to additional rows will be covered hereinafter. Given the size of the warhead, the mass of the individual fragments, and the number of rows, the angle theta shown in FIG. 2, the dimensions of the fragments, and the total number of fragments can be determined. All fragments are substantially identical in size and shape and easily fabricated.

The construction of the warhead is depicted in FIG. 1. A hollow cylindrical thin inner member or skin 10 is provided of proper size. The inner skin 10 serves two purposes. First, it provides a form upon which to easily construct the fragmentation package depicted in FIG. 3. Second, it remains in the warhead and prevents fragment deterioration during explosive detonation. Fragments 12 are assembled about the inner skin 10 using the row staggering algorithm shown in FIG. 5*a*, 5*b*, or 5*c* or as modified to produce a fragmentation pattern best suited to the particular target. As shown in FIGS. 2 and 3, each of the fragments 12 is substantially an elongated rectangular parallelepiped. The top and bottom and the two sides of each fragment are elongated rectangles. The two sides are inclined toward the central axis of the warhead, for keystoning the fragments together, and hence, the two ends of the fragment are slightly trapezoidal, instead of rectangular. Each elongated fragment has a longitudinal or major axis of symmetry located midway between the top, bottom and two sides. The fragments in the preferred embodiment are welded one to another at their ends. However, they could be bonded to each other and/or the inner skin without loss of effectiveness. A spacer 14 of any material or a physical space has been found to be helpful when placed between the rows where the shock waves will meet to act as a tolerance allowance, but is not absolutely necessary to the operation of the invention. The completed fragmentation portion will appear as depicted in FIG. 3.

In the preferred embodiment, as shown in FIG. 1, the warhead is assembled within an outer skin 16. The fragments 12 as assembled about the inner skin 10 are positioned within the outer skin 16 by the two rings 18 and the entire assembly held fast by the end caps 20 which are attached to the outer skin 16 as by welding so as to form an inner cavity 22. The cavity 22 includes two end spaces 23 that are formed between the two end caps 20 and the ends of the fragments 12 in the outermost rows of fragments, as shown in FIG. 1. The explosive charge is placed within and fills up this cavity 22. Detonation from both ends is accomplished by a single detonator 24 and explosive train 26 in the standard manner through appropriate entrance means provided in the end caps 20.

The operation of the present invention is depicted in FIG. 4. When the detonator 24 is actuated, the ignition charge travels down the two paths of the explosive train 26. With an even number of rows, detonation of the main explosive charge takes place simultaneously. The main shock waves 27 progress from the ends to the middle as shown. Consequently, the rows of fragments move out in order from the ends as shown by the ghost positions on one side in FIG. 4. Note tha the charge is tamped into the two end spaces 23. When the charge is detonated, axial force vectors depicted by the arrows 28 are exerted on the ends of the emerging fragments 12 and act like a choke in a shotgun to keep the fragments 12 in a confined beam so as to concentrate the kinetic energy over a smaller area. If an odd number of rows of fragments is used, the relative lengths of the explosive train paths from the detonator should be sized to cause the two shock waves to meet at the junction of the center row of fragments and a next adjacent row.

Figure 5B:
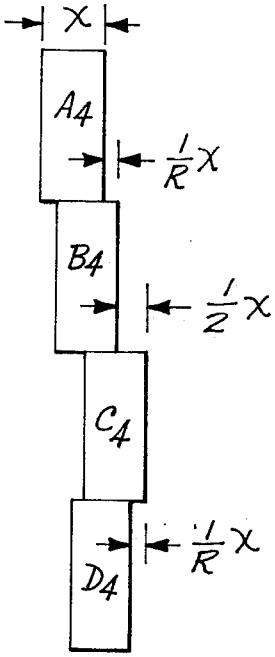
Figure 5C:
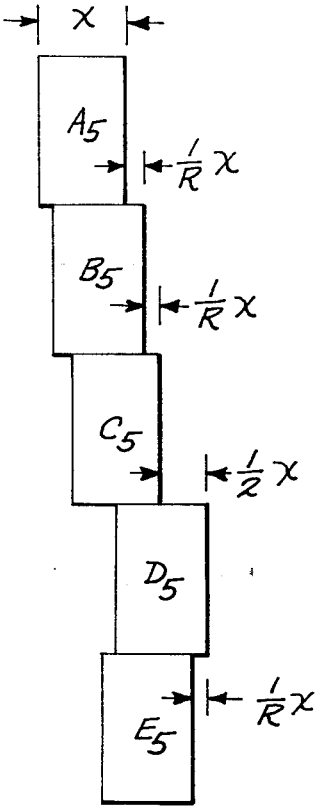

Referring to FIG. 5*a*, FIG. 5*b*, and FIG. 5*c*, the algorithm for staggering the annular rows of fragments is depicted for six, four, and five row warheads respectively. An even number of rows is easiest to work with and delivers a symmetrical kinetic energy pattern to the target. An odd number of rows would work, however, and the same reasoning for determining row stagger could be applied. In FIG. 4 the pattern of energy and resultant fragment movements is depicted. The fragmentation stagger algorithm used in the preferred embodiment was to cause the fragments in row pairs leaving the warhead at the same instant to be staggered by one-half the fragment width. This can be clearly seen by reference ro FIG. 5*a*, FIG. 5*b*, and FIG. 5*c* wherein the outer fragments ($A_6/F_6$ and $A_4/D_4$) inner fragments ($C_6/D_6$, $B_4/C_4$, and $C_5/D_5$) and intermediate fragments ($B_6/E_6$ and $B_5/D_5$) are each offset one-half a fragment width in relation one to the other. Note the example of an odd number of rows warhead as shown in FIG. 5*c*. The point at which the shock waves from the explosion meet is merely shifted away from the center of the warhead to the junction of the center row and a next adjacent row ($C_5/D_5$). The outer fragment $A_5$ has no corresponding half-width fragment with which to relate as it would in an even number of rows warhead. This would cause a slight offset in the delivered kinetic energy pattern; however, the basic foundation of the present invention would not be violated since a substantially balanced distribution of the kinetic energy in a predetermined manner would be maintained. More specifically, referring to FIG. 5*a*, the explosive shock waves will start at fragments $A_6$ and $F_6$, and move inward simultaneously toward the junction of fragments $C_6$ and $D_6$. The fragments $A_6$ and $F_6$ will move away from the warhead first (in the direction of the viewer) and be of lowest and equal kinetic energy. $B_6$ and $E_6$ will move out next. Finally, $C_6$ and $D_6$ the maximum kinetic energy fragment pair will move out. The underlying theory of operation of the present invention is to distribute fragments of equal kinetic energy across the target area. It was found that the fragments will be dispersed in direct relation to their positions in the warhead at the time of explosive detonation. Thus, by offsetting $C_6$ (secondary base row) one-half a fragment width in relationship to $D_6$ (primary base row) toward the next adjacent D row fragment ($D_6'$), this relationship will be maintained at target impact. Fragments $D_6$ and $D_6'$ will arrive at the target simultaneously a given distance apart depending on the distance travelled by the fragments. Fragment $C_6$ will arrive at the same instant at a point half-way between $D_6$ and $D_6'$. Notice that the remaining fragment pairs $B_6/E_6$ and $A_6/F_6$ retain the one-half width offset relationship by being offset the same amount in the same direction. The amount of offset of each row of fragments to the next adjacent row is the fraction represented by 1/number-of-fragment-rows. Consequently, in a six row warhead, such as illustrated in FIG. 5*a*, the kinetic energy is evenly distributed in 1/6 fragment width intervals such as the progression $D_6$, $E_6$, $F_6$, $C_6$, $B_6$, $A_6$ and beginning again with $D_6'$.

What is claimed, therefore, is:

1. A controlled fragmentation warhead comprising in combination:

a. A plurality of substantially identical elongated fragments, each having a longitudinal axis, assembled about a common axis to form form an annular structure having annular ends, said common axis being the longitudinal axis of said annular structure, said annular structure being comprised of substantially identical and contiguous annular rows of said fragments, the fragments in each of said annular rows being substantially contiguously disposed such that the longitudinal axes of the fragments in each of said annular rows are parallel to said common axis;

b. Means to enclose said annular structure so as to form a closed cavity therein, said enclosing means being so formed that said closed cavity includes an annular end space contiguous to each of said ends of said annular structure;

c. An explosive charge completely filling said closed cavity; and d. Means for substantially simultaneously detonating said explosive charge at both ends thereof;! whereby axial as well as radial explosive pressure is applied to said fragments by said detonation at both ends.

2. A controlled fragmentation warhead as claimed in claim 1, wherein the longitudinal axes of the fragments in each of said annular rows are circumferentially offset a predetermined distance from the longitudinal axes of the fragments in the next adjacent annular row.

3. A controlled fragmentation warhead as claimed in claim 2 having an even number of said annular rows of fragments and wherein said circumferal offset of the longitudinal axes of said fragments in each of said annular rows in relation to the longitudinal axes of said fragments in the next adjacent of said annular rows is according to a pattern wherein:

a. One of the most central pair of said annular rows of fragments is designated as the primary base row of fragments:

b. The other of the most central pair of said annular rows of fragments is designated as the secondary base row of fragments;

c. The longitudinal axes of the fragments in said secondary base row of fragments are circumferally offset substantially one-half the width of one of said fragments from the longitudinal axes of the fragments in said primary base row of fragments; and, d. Each of the remainder of said annular rows of fragments is circumferally offset an amount such that the longitudinal axis of each of said fragments is disposed to be offset from the longitudinal axis of the next adjacent of said fragments in the next adjacent of said annular rows of fragments a distance substantially equal to a fraction of the width of one of said fragments represented by one over the number of said annular rows of fragments in the same direction that said secondary base row of fragments is offset in relation to said primary base row of fragments.

4. A controlled fragmentation warhead as claimed in claim 2 having an odd number of said annular rows of fragments and wherein said circumferal offset of the longitudinal axes of said fragments in each of said annular rows in relation to the longitudinal axes of said fragments in the next adjacent of said annular rows is according to a pattern wherein:

a. The most central of said annular rows of fragments is designated as the primary base row of fragments;

b. One of the next adjacent of said annular rows of fragments to said primary base row of fragments is designated as the secondary base row of fragments;

c. The longitudinal axes of the fragments in said secondary base row of fragments are circumferally offset substantially one-half the width of one of said fragments from the longitudinal axes of the fragments in said primary base row of fragments; and, d. Each of the remainder of said annular rows of fragments is circumferally offset an amount such that the longitudinal axis of each of said fragments is disposed to be offset from the longitudinal axis of the next adjacent of said fragments in the next adjacent of said annular rows of fragments a distance substantially equal to a fraction of the width of one of said fragments represented by one over the number of said annular rows of fragments in the same direction that said secondary base row of fragments is offset in relation to said primary base row of fragments.

5. A controlled fragmentation warhead as claimed in claim 1 wherein said fragments are of substantially trapezoidal shape in planes perpendicular to the longitudinal axes of said fragments.

6. A controlled fragmentation warhead as claimed in claim 1 wherein said enclosing means includes a hollow cylindrical thin inner member disposed contiguous to said annular structure of fragments.

7. A controlled fragmentation warhead as claimed in claim 6 wherein said fragments are attached to said inner member.

8. A controlled fragmentation warhead as claimed in claim 6 wherein said fragments are bonded one to another.

9. A controlled fragmentation warhead as claimed in claim 6 wherein said fragments are welded one to another at their ends.

10. A controlled fragmentation warhead as claimed in claim 6 wherein one of said annular rows of fragments is separated from the next adjacent annular row of fragments by annular spacer means.

* * * * *